US009273256B2

(12) United States Patent
Gillis et al.

(10) Patent No.: US 9,273,256 B2
(45) Date of Patent: Mar. 1, 2016

(54) INCREASED PRODUCTION OF FUELS BY INTEGRATION OF VACUUM DISTILLATION WITH SOLVENT DEASPHALTING

(71) Applicant: Foster Wheeler USA Corporation, Houston, TX (US)

(72) Inventors: Daniel B. Gillis, Houston, TX (US); Joseph Woodson, Houston, TX (US)

(73) Assignee: Foster Wheeler USA Corporation, Houston, TX (US)

( * ) Notice: Subject to any disclaimer, the term of this patent is extended or adjusted under 35 U.S.C. 154(b) by 164 days.

(21) Appl. No.: 14/189,909

(22) Filed: Feb. 25, 2014

(65) Prior Publication Data

US 2014/0238898 A1 Aug. 28, 2014

Related U.S. Application Data

(60) Provisional application No. 61/780,678, filed on Mar. 13, 2013, provisional application No. 61/769,062, filed on Feb. 25, 2013.

(51) Int. Cl.
*C10G 67/04* (2006.01)

(52) U.S. Cl.
CPC ..... *C10G 67/049* (2013.01); *C10G 2300/1077* (2013.01); *C10G 2300/4081* (2013.01)

(58) Field of Classification Search
CPC ..... C10G 7/00; C10G 67/049; C10G 2300/4081; C10G 2300/1077; B01D 3/10; B01D 35/185; B01D 1/22
See application file for complete search history.

(56) References Cited

U.S. PATENT DOCUMENTS

| | | | | |
|---|---|---|---|---|
| 4,126,538 | A | 11/1978 | Goudriaan et al. | |
| 8,110,090 | B2 | 2/2012 | Zimmerman et al. | |
| 2007/0144944 | A1 | 6/2007 | Del Bianco et al. | |
| 2008/0083652 | A1 * | 4/2008 | Morel | C10G 21/003 208/86 |
| 2009/0050524 | A1 | 2/2009 | Kim et al. | |

FOREIGN PATENT DOCUMENTS

| | | | |
|---|---|---|---|
| EP | 0 673 989 | A2 | 9/1995 |
| EP | 1 096 002 | B1 | 7/2004 |

OTHER PUBLICATIONS

PCT International Search Report—issued in corresponding International application No. PCT/US2014/018415—mailing date May 22, 2014.

* cited by examiner

*Primary Examiner* — Randy Boyer
*Assistant Examiner* — Juan Valencia
(74) *Attorney, Agent, or Firm* — Winstead PC

(57) ABSTRACT

Embodiments of the claimed invention are directed to methods and apparatuses that recycle unconverted oil fractions resulting from a hydrocracking unit, by feeding the unconverted oil fractions into a vacuum flasher and processing the fractions obtained therefrom.

3 Claims, 3 Drawing Sheets

INCREASED PRODUCTION OF FUELS BY INTEGRATION OF VACUUM DISTILLATION WITH SOLVENT DEASPHALTING

CROSS-REFERENCES TO RELATED APPLICATIONS

This Application claims the benefit under 35 U.S.C. §119 (e) of U.S. Provisional Patent Application Ser. No. 61/769,062 filed Feb. 25, 2013, and U.S. Provisional Patent Application Ser. No. 61/780,678 filed Mar. 13, 2013 which are incorporated herein by reference in their entirety as if fully set forth herein.

FIELD OF THE INVENTION

The invention relates to the integration of vacuum distillation with solvent deasphalting in order to enhance production of fuels.

BACKGROUND OF THE INVENTION

Crude oils contain heteroatomic, polyaromatic molecules that include compounds such as sulfur, nitrogen, nickel, vanadium and others in quantities that can adversely affect the refinery processing of crude oil fractions. Light crude oils or condensates have sulfur concentrations as low as 0.01 percent by weight (W %). In contrast, heavy crude oils and heavy petroleum fractions have sulfur concentrations as high as 5-6 W %. Similarly, the nitrogen content of crude oils can be in the range of 0.001-1.0 W %. These impurities must be removed during refining to meet established environmental regulations for the final products (e.g., gasoline, diesel, fuel oil), or for the intermediate refining streams that are to be processed for further upgrading, such as isomerization or reforming. Furthermore, contaminants such as nitrogen, sulfur and heavy metals are known to deactivate or poison catalysts, and thus must be removed.

Asphaltenes, which are solid in nature and comprise polynuclear aromatics present in the solution of smaller aromatics and resin molecules, are also present in the crude oils and heavy fractions in varying quantities. Asphaltenes do not exist in all of the condensates or in light crude oils; however, they are present in relatively large quantities in heavy crude oils and petroleum fractions. Asphaltene concentrations are defined as the amount of asphaltenes precipitated by addition of an n-paraffin solvent to the feedstock.

In a typical refinery, crude oil is first fractionated in the atmospheric distillation column to separate sour gas including methane, ethane, propanes, butanes and hydrogen sulfide, naphtha (typical boiling point range: 36-180° C.), kerosene (typical boiling point range: 180-240° C.), gas oil (typical boiling point range: 240-370° C.) and atmospheric residue, which are the hydrocarbon fractions boiling above gas oil. The atmospheric residue from the atmospheric distillation column is either used as fuel oil or sent to a vacuum distillation unit, depending upon the configuration of the refinery. Principal products from the vacuum distillation are vacuum gas oil (typical boiling point range: 370-520° C.), and vacuum residue, comprising hydrocarbons boiling above vacuum gas oil.

Vacuum distillation is a well proven technology for physically separating atmospheric residue (AR) into vacuum gas oils (VGO) and vacuum residue (VR). Naphtha, kerosene and gas oil streams derived from crude oils or other natural sources, such as shale oils, bitumens and tar sands, are treated to remove the contaminants, such as sulfur, that exceed the specification set for the end product(s). Hydrotreating is the most common refining technology used to remove these contaminants. Vacuum gas oil is processed in a hydrocracking unit to produce gasoline and diesel, or in a fluid catalytic cracking (FCC) unit to produce mainly gasoline, light cycle oil (LCO) and heavy cycle oil (HCO) as by-products, the former being used as a blending component in either the diesel pool or in fuel oil, the latter being sent directly to the fuel oil pool.

Conventionally, a solvent deasphalting (SDA) process is employed by an oil refinery for the purpose of extracting valuable components from a residual oil feedstock, which is a heavy hydrocarbon that is produced as a by-product of refining crude oil. The extracted components are fed back to the refinery wherein they are converted into valuable lighter fractions such as gasoline, diesel, or lube oil. Suitable residual oil feedstocks which may be used in a SDA process include, for example, atmospheric tower bottoms, vacuum tower bottoms, crude oil, topped crude oils, coal oil extract, shale oils, and oils recovered from tar sands.

Solvent deasphalting (SDA) is used for physical separation of residues by their molecular type. A typical SDA flow scheme is shown in FIG. 1. The key vessel is the extractor where the separation of deasphalted oil (DAO) and pitch occurs. In a typical SDA process, a light hydrocarbon solvent is added to the residual oil feed from a refinery and is processed in what can be termed as an asphaltene separator. Common solvents used comprise light paraffinic solvents. Examples of light paraffinic solvents include, but are not limited to, propane, butane, isobutane, pentane, isopentane, neopentane, hexane, isohexane, heptane, and similar known solvents used in deasphalting, and mixtures thereof. Under elevated temperature and pressures, the mixture in the asphaltene separator separates into a plurality of liquid streams, typically, a substantially asphaltene-free stream of deasphalted oil (DAO), resins and solvent, and a mixture of asphaltene and solvent within which some DAO may be dissolved.

Once the asphaltenes have been removed, the substantially asphaltene-free stream of DAO, resins and solvent is normally subjected to a solvent recovery system. The solvent recovery system of an SDA unit extracts a fraction of the solvent from the solvent rich DAO by utilizing supercritical separation techniques or by boiling off the solvent, commonly using steam or hot oil from fired heaters. The separated solvent is then recycled back for use in the SDA unit.

SUMMARY OF THE INVENTION

An embodiment of the invention is directed to a process for recycling the unconverted oil fraction produced by a hydrocracking unit, the process comprising: feeding an atmospheric residue fraction into a vacuum distillation unit; processing the vacuum residue from the vacuum distillation unit in a solvent deasphalting extractor to obtain a deasphalted fraction; processing the deasphalted fraction in a hydrocracking unit to obtain a fraction of unconverted oil and a fraction of hydrocarbon products; and processing the fraction of unconverted oil in a vacuum flasher (VF) to obtain a VF distillate fraction and a VF bottoms fraction, wherein said VF bottoms fraction is subjected to additional processing in a solvent deasphalting extractor.

DETAILED DESCRIPTION OF EXEMPLARY EMBODIMENTS

The yield of DAO is set by the processing feed stock property limitations, such as organometallic metals content and Conradson Carbon residue (CCR) of the downstream processes. These limitations are usually below the maximum recoverable DAO within the SDA process. Table 1 illustrates yields obtained in a SDA process in accordance with an embodiment of the invention. If the DAO yield can be increased, then the overall valuable transportation fuel yields, based on residue feed, can be increased, and the overall profitability enhanced. A parallel benefit would occur with the combination of SDA followed by delayed coking. Maximizing DAO yield maximizes the catalytic conversion of residue relative to thermal conversion, which occurs in delayed coking.

TABLE 1

| | Feed | DAO | Pitch |
|---|---|---|---|
| Vol-% | 100.00 | 53.21 | 46.79 |
| Weight-% | 100.00 | 50.00 | 50.00 |
| API | 5.37 | 14.2 | −3.4 |
| Sp. Gr. | 1.0338 | 0.9715 | 1.1047 |
| S, wt-% | 4.27 | 3.03 | 5.51 |
| N, wppm | 3000 | 1250 | 4750 |
| Con Carbon, wt % | 23 | 7.7 | 38.3 |
| C7 insols, wt-% | 6.86 | 0.05 | 13.7 |
| Ni + V, wppm | 118 | 7 | 229 |

Figure 1:
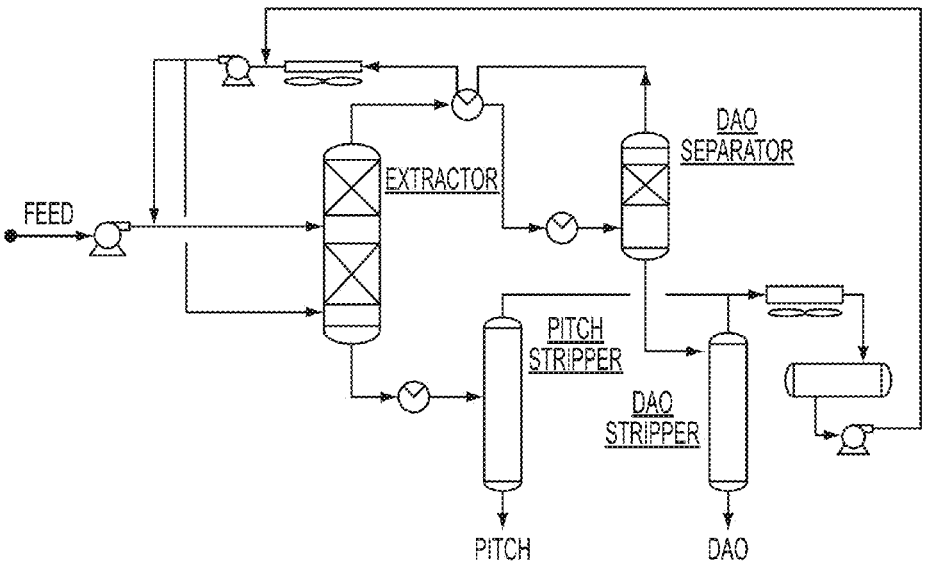
FIG. 1 shows a typical solvent deasphalting flow scheme in accordance with an embodiment of the invention.
Figure 2:
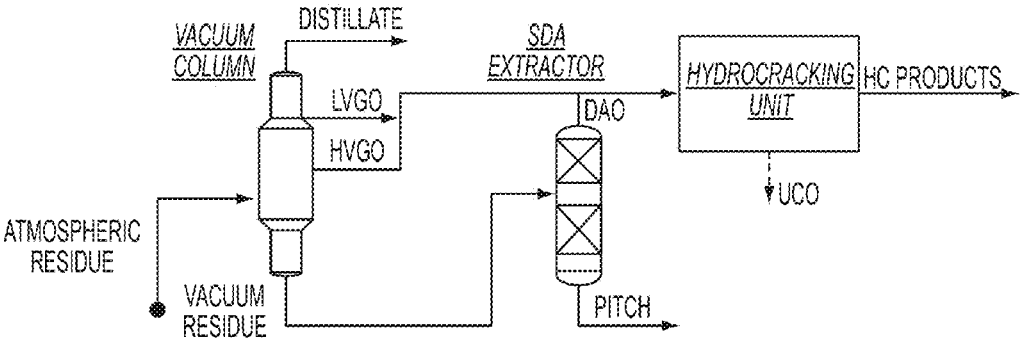
FIG. 2 shows a typical VDU-SDA-HC flow scheme in accordance with an embodiment of the invention.
Figure 3:
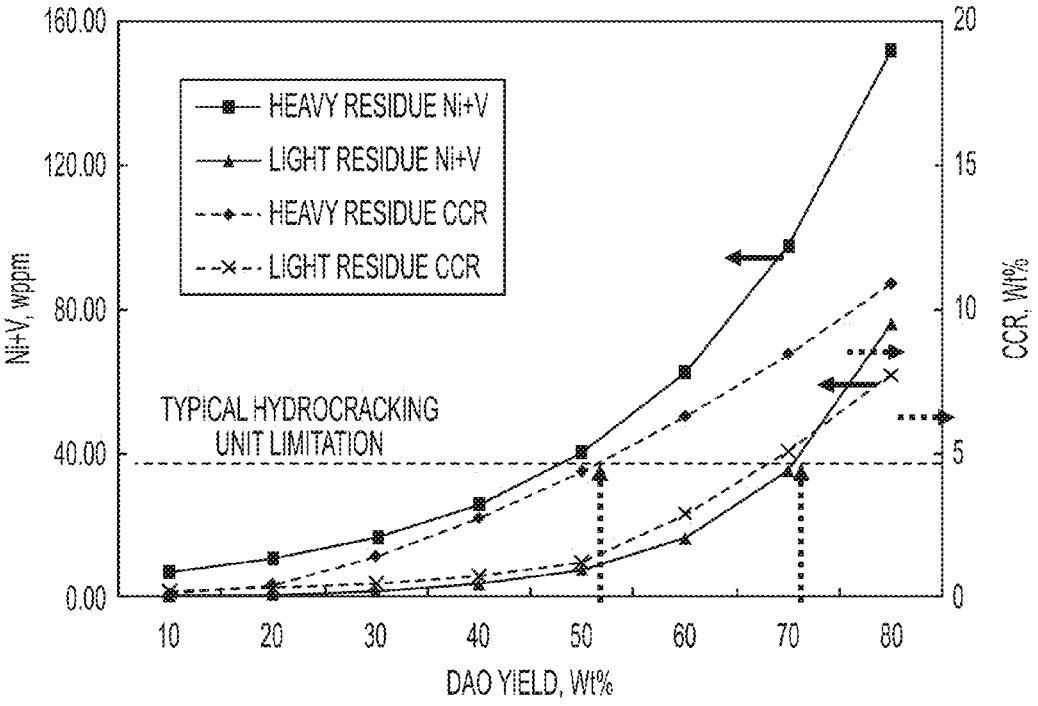
FIG. 3 shows the qualities of deasphalted oil relative to residue type and yield in accordance with an embodiment of the invention.

The recovered deasphalted oil (DAO) is typically utilized in downstream processes such as a VGO Hydrocracking (HC) process, or as feedstock to a lube oil plant. A typical VDU-SDA-HC flow scheme is shown in FIG. 2. When processing DAO in a HC, the yield of DAO is usually set by the HC feed stock quality limitations, such as concentrations of organometallic metals, Conradson Carbon Residue (CCR), and asphaltenes. DAO yields at the maximum recoverable DAO within the SDA process usually result in contaminant levels above the feed stock quality limitations of downstream units (Table 1, FIG. 3).

When processing DAO in a HC, the maximum conversion is usually less than that when processing straight run vacuum gas oils due to the detrimental effects of processing DAO on the HC catalyst stability. This requirement to reduce conversion when processing DAO to maintain HC catalyst stability results in significantly higher yield of unconverted oil (UCO), which has a significantly lower value than transportation fuels such as diesel or gasoline.

It would be desirable to maximize HC feed conversion to minimize the UCO stream and maximize the profitability of the HC. Only a small fraction of the UCO components actually need to be purged. These are the polynuclear aromatics (PNA) present in the UCO. If not purged from the HC process, these PNA's will result in an increased concentration of the heavy poly nuclear aromatics (HPNA) that will result in rapid catalyst deactivation. The rest of the UCO is very suitable for conversion in the HC. Unfortunately the PNA's cannot be separated from the rest of the UCO molecules with conventional fractionation.

Unless a refinery has another process, such as a fluidized catalytic cracker (FCC), that can catalytically convert the UCO, the UCO is sent to a low value fuel oil pool or used as a cutter stock. This results in less than desired overall conversion of AR to higher value transportation fuels.

SDA DAO has been processed in HC commercial processes, however the UCO yield is usually much higher than desired, and/or the maximum allowable percentage of DAO processed in the HC is limited to a minority fraction of the total feed.

Figure 4:
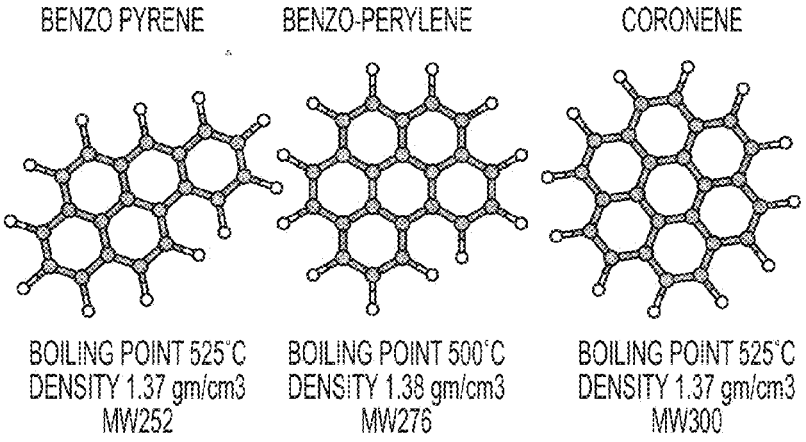
FIG. 4 shows the boiling range of multiring aromatics in accordance with an embodiment of the invention.

Recycling the UCO back to the upstream vacuum distillation unit (VDU) has also been commercially practiced when the distillation cut point between VGO and VR is reduced to a relatively low value compared to typical VDU operations. This operation is counter to the objective to maximize VGO recovery (and therefore maximize HC feedstock), since some VGO boiling material is left in the VR. Unless the VGO/VR cut point is significantly reduced there is not a sufficient separation of multi-ring aromatics from the VGO and UCO due to the wide boiling range of multiring aromatics as shown in FIG. 4. Further, if the VR is sent to a SDA process, then the incremental heavy VGO allowed to remain in the residue will act as a cosolvent, thereby increasing the contaminant and PNA content of the DAO from the SDA process.

The claimed invention includes several key components that increase valuable transportation fuel yields when processing AR in a VDU-SDA-HC flow scheme. The claimed invention can also be applied separately for a SDA-HC combination process where integration with the upstream VDU is not possible or the SDA processes AR or a combination of AR+VR and not just VR.

In an embodiment of the invention, the UCO is separately fractionated in a vacuum flasher (VF) that has a VGO end point equal to or lower than typically obtained in a VDU when processing AR.

In a further embodiment of the invention, the VF is integrated with the upstream VDU when possible to reduce the capital and operating costs of the VF.

In other embodiments of the invention, the VF bottoms (UCO HVGO) are routed to the SDA unit, usually in conjunction with the VR from the VDU's vacuum fractionation column. Furthermore, in certain embodiments, the VF flashed distillate (UCO LVGO) is routed to the VDU vacuum fractionation column for further separation. In other embodiments of the invention, the vacuum systems are shared with the VDU when possible, and in certain cases, there is heat integration of the VDU and SDA processes.

Figure 5:
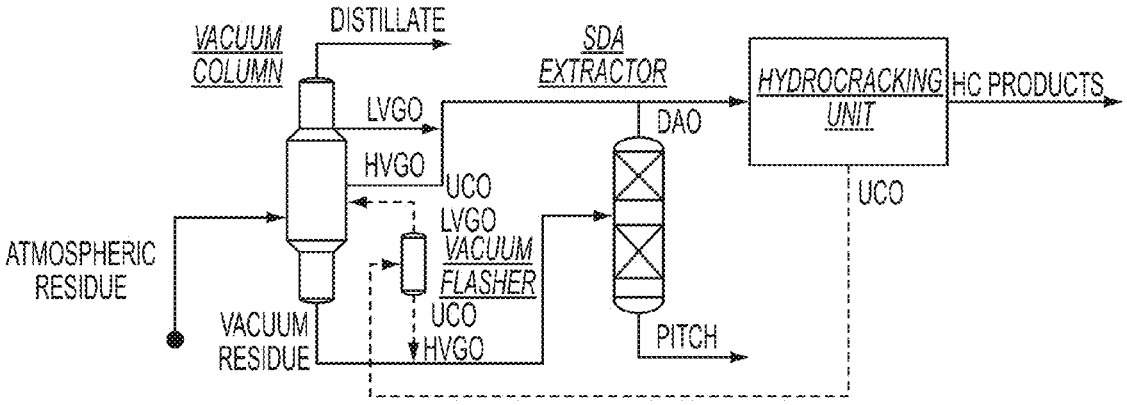
FIG. 5 shows an illustration of the typical integrated VDU-VF-SDA flow scheme in accordance with an embodiment of the invention.

FIG. 5 is an illustration of the typical integrated VDU-VF-SDA flow scheme, with UCO routing to the VF. In an alternative embodiment of the invention, the VF is a standalone unit that may be heat integrated with the SDA process. A further embodiment is one where the UCO vacuum flasher is replaced with a vacuum column including internals in order to improve the separation between light and heavy UCO fractions.

Relative to a typical VDU-SDA-HC flow scheme the overall AR conversion can be increased by over 5.0 wt %. An example of the yield shifts is shown in Table 2. For this scenario the base operation prior to the invention would have the SDA DAO yield limited to 75 wt % and the UCO purge at a minimum of 5 wt % from the HC. This would result in an overall AR conversion of 86.9 wt %. Table 2 shows the overall material balance before and after selective UCO recovery. All values in Table 2 are shown in wt %.

TABLE 2

| | Typical | With UCO Recycle | Yield Shift |
|---|---|---|---|
| Feed Rate: | 100.00% | 100.00% | 0.00% |
| Hydrogen | 2.38% | 2.53% | 0.14% |
| TOTAL IN | 102.38% | 102.53% | 0.14% |
| COMPLEX OUT | | | |
| Vac Diesel | 0.92% | 0.92% | 0.00% |
| H2S/NH3 | 1.64% | 1.67% | 0.03% |
| C1-C2 | 0.58% | 0.53% | −0.05% |
| C3-C4 | 2.25% | 2.26% | 0.02% |
| Naphtha | 12.46% | 14.54% | 2.09% |
| Distillates | 71.29% | 74.65% | 3.36% |
| UCO | 4.10% | 0.00% | −4.10% |
| DAO | 27.46% | 32.85% | 5.39% |
| Pitch | 9.15% | 7.95% | −1.20% |
| TOTAL OUT | 102.38% | 102.52% | 0.14% |
| C3+ Liquid Conversion | 86.91% | 92.37% | 5.47% |

In accordance with embodiments of invention, the DAO yield can be increased to 80 wt % as the incremental contaminants including PNAs will be purged with the UCO. As the UCO is recycled back to the VDU-SDA from the HC, the bulk of the UCO is recovered as quality HC feed and the effective HC conversion increases to over 99 wt %. The combination of the higher DAO yield and higher HC conversion results in an overall AR conversion of 92.4 wt %, which is an overall increase of 5.5 wt %.

For a 50,000 BPD AR feed rate, the annual benefit of this alternative flow scheme could be over $50 million per year based on an upgrade value of $60/bbl of transportation fuels over UCO when it is sent to the fuel oil pool.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments will become apparent to those of ordinary skill in the art upon reading the foregoing description. Accordingly, this invention includes all modifications and equivalents of the subject matter recited in the claims appended hereto.

What is claimed is:

1. A process for recycling the unconverted oil fraction produced by a hydrocracking unit, the process comprising:

feeding an atmospheric residue fraction into a vacuum distillation unit;

processing the vacuum residue from the vacuum distillation unit or an atmospheric residue from a crude distillation unit in a solvent deasphalting extractor to obtain a deasphalted fraction;

processing the deasphalted fraction in a hydrocracking unit to obtain a fraction of unconverted oil and a fraction of hydrocarbon products;

processing the fraction of unconverted oil in a vacuum flasher to obtain a VF distillate fraction and a VF bottoms fraction, wherein said VF bottoms fraction is subjected to additional processing in a solvent deasphalting extractor; and transferring the VF distillate fraction to the vacuum distillation unit.

2. The process according to claim 1, wherein the VF bottoms fraction is combined with the vacuum residue from the vacuum distillation unit prior to being transferred to a solvent deasphalting extractor.

3. The process according to claim 1, wherein the vacuum flasher is replaced by a vacuum distillation column.

* * * * *